US012458826B2

(12) United States Patent
Andon et al.

(10) Patent No.: US 12,458,826 B2
(45) Date of Patent: Nov. 4, 2025

(54) PLAYGROUND APPARATUS WITH OVERPASS

(71) Applicant: SYSTEMS IP PTY LTD, Wakerley (AU)

(72) Inventors: Joe Andon, Wakerley (AU); Akira Yamada, Wakerley (AU); Michael Williams, Wakerley (AU)

(73) Assignee: Systems IP Pty Ltd, Wakerly (AU)

( * ) Notice: Subject to any disclaimer, the term of this patent is extended or adjusted under 35 U.S.C. 154(b) by 0 days.

(21) Appl. No.: 18/955,780

(22) Filed: Nov. 21, 2024

(65) Prior Publication Data

US 2025/0082977 A1 Mar. 13, 2025

Related U.S. Application Data

(63) Continuation of application No. PCT/AU2024/050304, filed on Apr. 1, 2024.

(30) Foreign Application Priority Data

Apr. 1, 2023 (AU) ..... 2023900928

(51) Int. Cl.
*A63B 9/00* (2006.01)
*A63B 71/02* (2006.01)

(52) U.S. Cl.
CPC ..... *A63B 9/00* (2013.01); *A63B 71/022* (2013.01); *A63B 2009/006* (2013.01); *A63B 2209/10* (2013.01)

(58) Field of Classification Search
CPC ..... A63B 2009/002–006; A63B 5/11
See application file for complete search history.

(56) References Cited

U.S. PATENT DOCUMENTS 5,984,837 A * 11/1999 Weaver ..... A63B 9/00 160/DIG. 15
6,093,134 A * 7/2000 Worsham ..... A63B 9/00 482/35

(Continued)

FOREIGN PATENT DOCUMENTS

AU 2020101972 10/2020
AU 2021104531 9/2021

(Continued)

OTHER PUBLICATIONS

PCT Written Opinion of the International Searching Authority.

(Continued)

*Primary Examiner* — Nyca T Nguyen
(74) *Attorney, Agent, or Firm* — Scott D. Swanson; Shaver & Swanson LLP

(57) ABSTRACT

A playground apparatus is provided comprising a frame structure. The frame structure comprises at least one elevated platform supported around at least a part of its periphery by the frame structure. Cover support poles are associated with the frame structure and located near to the platform. The cover support poles are configured to provide support for a cover that extends over a least a portion of the platform. There is also at least one side wall between the platform and the cover to provide a partially enclosed elevated play space in the playground apparatus.

24 Claims, 9 Drawing Sheets

(56) References Cited

U.S. PATENT DOCUMENTS

| | | | | |
|---|---|---|---|---|
| 6,319,135 | B1 * | 11/2001 | Monson | A63G 1/28 472/32 |
| 6,402,631 | B1 * | 6/2002 | Gembarowicz | A63B 71/022 473/197 |
| 7,762,927 | B1 * | 7/2010 | Gordon | A63B 5/11 482/35 |
| 8,430,795 | B2 * | 4/2013 | Publicover | A63B 5/11 482/35 |
| 2004/0002394 | A1 * | 1/2004 | Heipp | A63B 17/00 472/136 |
| 2004/0224823 | A1 * | 11/2004 | Myers | A47D 13/06 482/35 |
| 2008/0051257 | A1 * | 2/2008 | Hamblin | A63G 9/12 482/35 |
| 2008/0207344 | A1 * | 8/2008 | Huerta | A63G 21/02 472/116 |
| 2008/0282621 | A1 * | 11/2008 | Chen | A63J 11/00 52/36.2 |
| 2012/0071252 | A1 * | 3/2012 | Georg | A63G 21/02 472/92 |
| 2017/0080270 | A1 * | 3/2017 | Andon | A63B 5/11 |
| 2017/0165583 | A1 * | 6/2017 | Keller | A63B 9/00 |
| 2017/0326400 | A1 * | 11/2017 | Brennan | A63B 71/0054 |
| 2020/0238152 | A1 * | 7/2020 | Hagel | A63B 21/0428 |
| 2022/0168605 | A1 * | 6/2022 | Janicki | A63B 7/00 |
| 2024/0023726 | A1 * | 1/2024 | Sharp | A63B 17/04 |

FOREIGN PATENT DOCUMENTS

| | | | | |
|---|---|---|---|---|
| CN | 105640158 | A * | 6/2016 | A47D 11/005 |
| CN | 213192481 | U * | 5/2021 | |
| GB | 2461335 | A * | 1/2010 | A63B 5/11 |
| GB | 2591110 | | 7/2024 | |
| KR | 200375749 | Y1 * | 3/2005 | |
| KR | 102219002 | | 2/2021 | |

OTHER PUBLICATIONS

PCT Notification of Transmittal of the International Search Report and the Written Opinion of the International Searching Authority, or the Declaration.

* cited by examiner

PLAYGROUND APPARATUS WITH OVERPASS

The present document claims priority to international application No. PCT/AU2024/050304, entitled: A playground apparatus with overpass, filed 1 Apr. 2024, which claims priority to AU2023900928 entitled: A playground apparatus with overpass, filed on 1 Apr. 2023, the contents of each of which are hereby incorporated by reference in their entirety.

TECHNICAL FIELD

The present invention relates to a playground apparatus. In particular, the present invention is directed to playground apparatus which has an elevated play space.

BACKGROUND

Elevated play spaces are a component of many playground apparatus structures. They are designed to offer children the opportunity to play and climb at heights, providing a fun and challenging experience. Elevated play spaces often include elements such as monkey bars, balance beams, and other climbing features. Elevated play spaces can also include platforms.

These platforms are often elevated above ground level, offering children a different perspective and a more challenging play experience. Platform play structures can come in various shapes and sizes, from simple raised platforms to more complex designs with multiple levels, bridges, and slides. These structures may also include climbing elements such as ladders or ropes to reach the elevated platform. In all playground structures, it is crucial to ensure that these structures are built and maintained with adequate safety measures to prevent injuries or accidents.

At present, the play industry falls short of providing sufficient safety measures for elevated play spaces, increasing the likelihood of injuries and even fatalities. Some elevated play structures that are located adjacent to monkey bars, can pose head entrapment risks if the overlapping bars are too close to one another. Furthermore, the mounting methods for some elevated platform structures often involve straps that create large holes on the sides of the platform, posing additional injury risks. Notwithstanding the risks, the play industry is keen to integrated elevated play spaces into their apparatus since children enjoy the sense of adventure and challenge. Being also to climb, balance, sit/lay and or move at different heights can provide a unique and exciting experience compared to ground-level play.

The present invention seeks to provide a playground apparatus with an elevated play space that overcomes at least some of the problems of the prior art, or at least provides a useful alternative.

SUMMARY OF INVENTION

In a first aspect there is provided a playground apparatus comprising a frame structure, wherein the frame structure comprises:

- at least one elevated platform, the platform being formed from a soft pliable material supported around at least a part of its periphery by the frame structure,
- cover support poles associated with the frame structure and located near to the platform, the cover support poles configured to provide support for a cover that extends over a least a portion of the platform; and

- at least one side wall between the platform and the cover to provide a partially enclosed elevated play space in the playground apparatus.

The playground apparatus can be a climbing structure. The frame structure of the playground apparatus includes upright support poles, and horizontal bars. In embodiments there are multiple upright support poles, and multiple horizontal bars. There can be any number of either of the poles and horizontal bars. The horizontal bars are arranged relative to the poles. By relative to the support poles it can mean that the horizontal bars are attached to the support poles so as to provide the frame arrangement.

The upright support poles are typically substantially vertical. The horizontal bars are typically substantially horizontal. Either sets of poles or horizontal bars can be disposed in any angular orientation offset from vertical or horizontal. For the horizontal bars in a climbing frame or monkey bar apparatus the arrangement can be any provided the user can grasp them with their hands and or leg, and swing and or rotate their body, or climb. The frame structure can include a main frame structure. The main frame structure can comprise four upright poles arranged in a square or rectangular configuration when viewed from above. This structure is like an open cube.

The upright support poles are rigid structures once formed meaning that they do not move in use. The rigidity is provided by the strong material of the support poles. The rigid poles are also immobile which means that they do not move in use. There can be further upright poles to provide for more complex frame structure within the main frame structure. The horizontal bars can be arranged relative to the upright poles such as around and between the upright poles. The horizontal bars can be attached to the upright poles. The horizontal bars can be adjustably attached to the poles. Any configuration of horizontal bars can be designed to provide for excitement, aesthetic, function and or form. The playground apparatus can comprise one or more ladders for climbing to the top of the frame, and or one or more ladders arranged substantially horizontally (or offset from horizontal) relative to the frame, which the user can use to swing across "monkey style". The playground apparatus can also include attachments such as trampoline(s), cargo net(s), swing(s), slide(s), or any other playground attachment that is desirable.

The upright support poles can be made of any material such as plastic or metal. The poles can be tubes. The poles can be of any cross-sectional shape. In an embodiment, the poles are tubular. In an embodiment, the poles are hollow. The poles can be smooth and easy to grip. The poles can comprise kinks to provide for an aesthetically pleasing, unusual or interesting frame.

The horizontal bars can be made of strong cables, wires, ropes, plastic or metal. The bars can be tubes or poles. The horizontal bars can be of any cross-sectional shape. In an embodiment, the horizontal bars are tubular.

In an embodiment, the horizontal bars are hollow. The horizontal bars can be the same as or narrower in diameter than the support poles. The horizontal bars can be sized so as to be smooth and easy to grip. The horizontal bars can comprise kinks to provide for an aesthetically pleasing, unusual or interesting monkey bar frame. The upright support poles and horizontal bars can be the same components used in different orientations.

The upright support poles and horizontal bars are attached to one another to form a frame. The poles or bars can be connected to one another by welding or other permanent joining technique. Alternatively, at least some of the connections between poles (pole to pole or pole to bar) can be by a connector such as a knuckle joint connector. The knuckle joint connector can allow for articulation about the joint. The join between poles can therefore be disposed at any angle during formation of the frame structure. Other connector or couplers can be used as desired.

The platform within the frame structure can be of any shape including square, circular, rectangular, triangular. The frame can be designed to enclose at least a part of the platform's edges. The platform can be connected to the frame at all of its edges. If the platform is circular, the platform can be connected around all or almost all of its edges. Where the platform is a quadrilateral, the platform can be connected to the frame along all of its edges or e.g. only three of its edges. Alternatively, the platform can be connected to the frame along a pair of edges that are disposed opposite to one another.

The platform can be arranged in the frame structure so as to be elevated from the ground. Elevated generally refers to any play space or structure that is located above ground level or that raises a child's play level above the ground. The specific height at which a play structure is considered elevated may vary. However, typically, a play structure is considered elevated if it raises the child's level of play to a height that requires them to climb up to the play space. The climbing up into the play space can be by using the frame or by use of a ladder. In some embodiment, the elevated play space is at least higher than the height of an average child. The average child aged about 6 is about 107 to 117 cm, so the play space can be higher than that. The average child aged about 10 is about 127 to 145 cm, so the play space can be higher than that. In an embodiment, the platform is arranged at a height that is at least or at most about 1.8 m to at least about 2.4 m from the ground. The level of the platform is measured from the platform surface.

The platform can be substantial horizontal. In some embodiments the platform can be offset from horizontal. The frame structure of the play space could be shaped to support a corresponding angled platform. However, this would be less comfortable as an enclosed play space. In some embodiments, the platform has a horizontal part and a angled part.

The platform could be made from ropes pulled tightly across the frame structure at close intervals to simulate a floor. The platform can be a solid material. In an embodiment, the platform is made from plastic. Plastic is durable and lightweight and can withstand the wear and tear of regular use. Plastic platforms can come in a variety of shapes and sizes and can be designed to fit a range of different play structures. The plastic of the platform can be moulded into complex shapes and patterns, and can be coloured to create an exciting and visually appealing play experience. Additionally, plastic is a relatively low-maintenance material that can withstand exposure to the elements without corroding or degrading over time.

Alternatively, the platform is made from material. The material that the platform is made of could be a type of fabric material, such as canvas, polyester, nylon, or PVC-coated polyester. These materials are commonly used in the manufacture of tents, tarps, and other outdoor equipment, and are known for their durability, strength, and resistance to the elements. Canvas is a heavy-duty cotton or linen fabric that is naturally breathable and water-resistant. Polyester is a synthetic material that is lightweight, strong, and resistant to stretching and shrinking. Nylon is another synthetic material that is known for its high strength-to-weight ratio and excellent abrasion resistance. PVC-coated polyester is a polyester fabric that has been coated with polyvinyl chloride (PVC), which provides additional strength, waterproofing, and resistance to UV radiation. The platform may a waterproof or water-resistant coating or laminate to help protect it from moisture and the elements. In an embodiment, The platform is reinforced. The reinforcement can be with belting. The belting can be for example 50 mm wide PP belt to create a more stable surface.

The platform can be made from a flexible material. A platform that is made of a flexible material can offer a unique and exciting play experience for children. Unlike a solid platform, a flexible platform can bend and sway in response to a child's movements, creating a dynamic and interactive play space that can challenge children's balance, coordination, and motor skills. Additionally, a flexible platform can add an element of unpredictability and adventure to play. Children can feel a sense of thrill and excitement as they explore the platform, not knowing exactly how it will respond to their movements. This can encourage children to take risks, experiment with different movements and postures, and develop their confidence and resilience. In some instances, a flexible platform can also offer a tactile and sensory experience for children. The texture and feel of the flexible material can be interesting and engaging, providing a sensory-rich environment that can stimulate children's imagination and creativity.

The fabric platform can be removably attached to the frame using strong and durable materials. By being removable, the user can change the location of the platform if desired. In an embodiment, loops can be sewn onto the edges of the platform material. These loops can be threaded through the frame elements during manufacture. Alternatively, the platform can be secured to the frame using a hook and loop fastener, ties, or other. There can be apertures in the platform material into which a fastener can be inserted and then secured to the frame. The apertures can be reinforced with e.g. metal.

In a preferred embodiment, a strong hook and loop type of fastener can be used. Strips of hook-and-loop fastener material can be sewn onto the edges of the platform for engagement with the frame. The hook and loop fastener can wrap around the bars of the frame and then attach firmly to itself. The hook and loop fastener can be of the type with two or three overlapping parts. Where there are three overlapping parts, the middle part can wrap around the frame element, a first outer part wraps around from one side and engages with that part, and a second outer part wraps around from the other direction and engages with the outside surface of the first outer part. The result is a very strong connection that is unlikely to come loose in use. An advantage of this type of hook and loop fastener is that the gap between the platform edge and the frame is minimised which reduces any tendency for a child to trap hair, fingers and or loose clothing. The strips of fastener material can be designed to withstand the stresses of outdoor use and exposure to the elements. Another advantage of using a hook and loop type of fastener system is that it can allow for some flexibility and movement of the platform, while still maintaining a secure connection to the frame. This can be particularly useful in a play environment where children may be climbing, as the fastener can absorb some of the shocks and stresses of these activities.

The hook and loop type fastener can be arranged along substantially all of the length of the edge of the platform so there are no gaps between the platform and the frame. Alternatively, the hook and loop type fastener is arranged in parts along the edge of the platform. The overall amount of edge having fastener can be greater than the overall amount of edge free from fastener. The spacing between the fastener portions can be smaller than the width of the fastener portions themselves. In one or more embodiments, the width of the fastener material is at least about 7.5, 8, 10, 12 or 14 cm. In an embodiment, the spacing between each piece of fastener is less than the width of the fastener. There can be different types of fasteners along different edges.

In an embodiment, the fasteners are evenly spaced. The fasteners can be spaced so they create a gap in the range from about 160 mm to 250 mm, such as 180 mm to 230 mm. In embodiments, the gap between the fastener is not larger than about 160 mm, 180 mm, 200 mm, 210 mm, 230 mm or 250 mm.

The cover support poles can be integrated into the overall frame structure of the play space in a variety of ways, depending on the specific design of the structure. In some cases, the poles may be attached directly to the frame using brackets or other hardware, while in other cases, the cover support poles may be the top parts of the upright support poles. In some embodiments, the cover support poles are the top parts of the upright poles forming the play structure. The placement and spacing of the cover support poles will depend on the size and shape of the play structure, as well as the weight and tension of the cover. The poles may be evenly spaced around the perimeter of the structure, or they may be clustered in certain areas to provide additional support or stability.

The cover can be formed from the same material as the platform. Alternatively, the cover is formed for a different material. The cover can be shade cloth, which is a tightly-woven mesh material that is designed to block out a portion of the sun's rays while still allowing air and moisture to pass through. Shade cloths can come in a variety of colours and patterns and are often used to create a cool and comfortable space for children to play in on hot days. The cover can be a tarpaulin, which is a heavy-duty waterproof material that is commonly used to cover items outdoors or to protect them from the elements. In some embodiments, a more elaborate cover may be used on the play structure, such as a fabric canopy or tent-like structure that is designed to provide a shaded or enclosed space for children to play in. These types of covers can come in a variety of shapes and sizes, and may be designed to match the overall aesthetic or theme of the play apparatus. The cover can be windows or openings are desired. The cover may a waterproof or water-resistant coating or laminate to help protect it from moisture and the elements.

The cover can be disposed substantially horizontally in the frame structure. A horizontal cover and a horizontal platform can form two layers of substantially co-planar fabric. The cover can be disposed at other angles as desired.

When a cover is placed over the fabric platform, it creates an additional layer of fabric. This means that there are now two layers of fabric present in the play apparatus—the fabric platform itself and the cover that has been placed over it. The cover can be over all of the platform. The cover can be over a part of the platform. The cover can cover more area than just the platform.

The side walls of the space between the platform and the cover can be solid. The side walls can be open or openable. In an embodiment, the side walls of the enclosed elevated play space can be made of mesh. Mesh provides a light-weight and breathable option for the walls. Mesh walls could be made from a variety of materials, such as nylon, polyester, or vinyl-coated polyester, and would typically feature a grid-like pattern of holes or openings to allow for airflow and visibility.

Mesh walls can be an attractive option for play structures in warm or humid climates, as they allow for ventilation. Mesh walls can be a good option for play structures that are designed for younger children, as they provide a degree of visibility and ventilation while still providing some protection and containment for the children inside. The specific type of mesh material used will depend on a variety of factors, including the intended use of the play structure, the climate in which it will be used, and the overall design aesthetic of the structure. The mesh can be attached to the platform and or the frame by any means.

Each face of the proposed enclose play space can comprise a separate wall. Alternatively, a wall can wrap around the upright support poles/cover support poles to enclose the play space. The enclosed space can be designed to have only one entry and exit point. Alternatively, there can be more than one entry point and more than one exit point. In an embodiment, the only entry and exit into the enclosed space is through or adjacent the cover or through the platform. In this embodiment, the mesh walls are around the whole enclosed space.

The present arrangement provides an enclosed elevated play space with a closed or semi-closed structure that can in embodiments provide children with a unique and exciting play experience. The enclosed structure typically features walls, a roof in the form of a cover, and a floor in the form of the platform that is elevated above the ground level. The enclosed elevated play spaces can come in a variety of shapes and sizes. One benefit of the enclosed elevated play space is that it can offer children a sense of privacy and a contained play area. This can encourage children to engage in imaginative and creative play scenarios without feeling exposed or self-conscious. The enclosed structure can also provide a sense of safety and security, allowing parents and caregivers to supervise children more easily.

BRIEF DESCRIPTION OF THE FIGURES

Embodiments of the invention will now be described with reference to the accompanying drawings which are not drawn to scale and which are exemplary only and in which.

DETAILED DESCRIPTION OF EMBODIMENTS OF THE INVENTION

Figure 1:
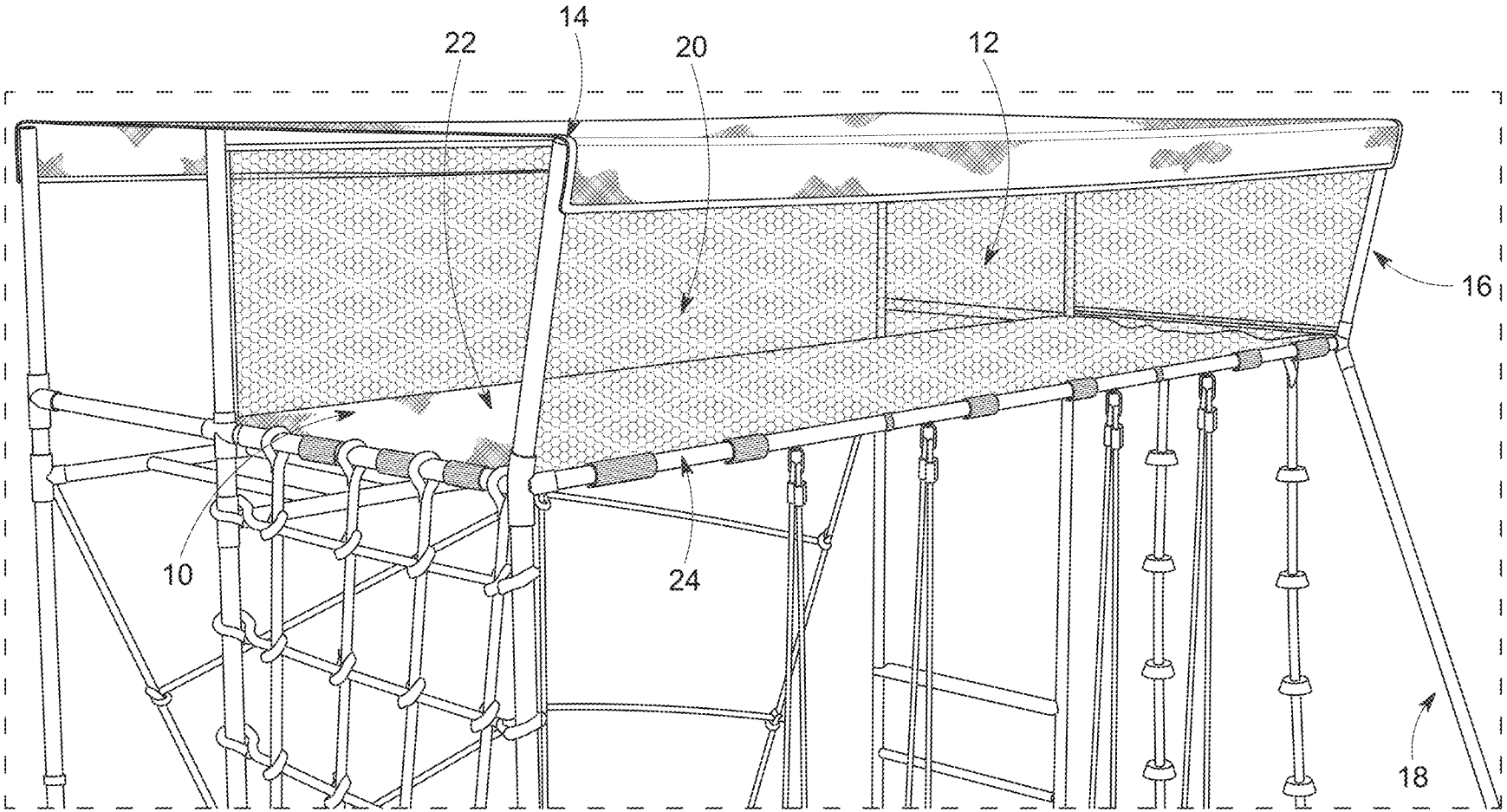
FIGS. 1 to 3 are perspective views of embodiments of the playground apparatus with an enclosed elevated play space.
Figure 8:
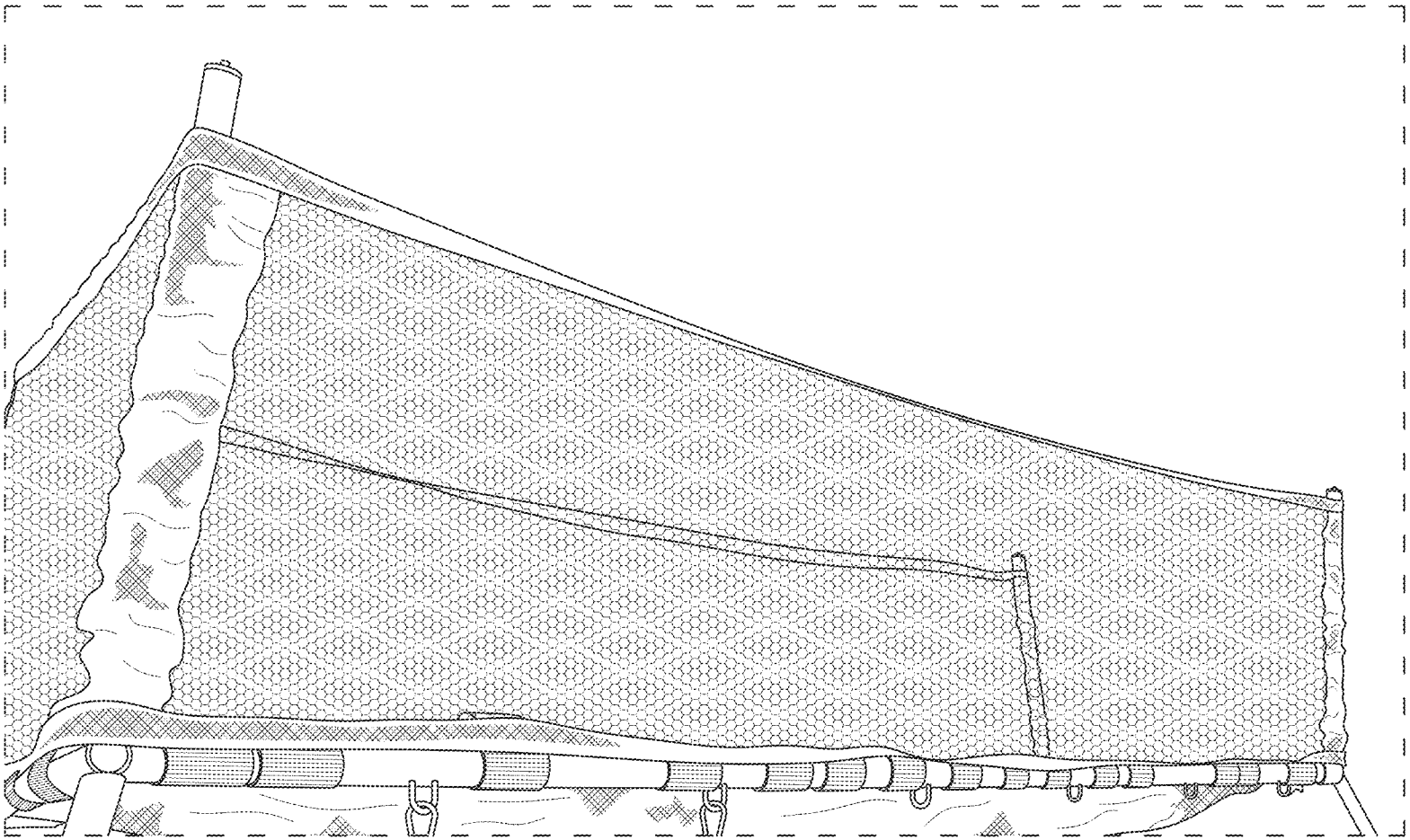
FIG. 8 is an embodiment without a roof cover.

FIG. 1 shows the elevated enclosed space 10 at the top of a playground apparatus. The platform 22 is shown attached around its peripheral edges to the frame structure 24. There is a cover 14 and mesh wall 20. An entry point 12 is formed by an opening in the mesh wall 20. The cover support poles 16, which are in this embodiment an extension of the upright poles 18, are supporting cover 14. The cover support poles 16 are separate pieces to the upright poles 18 in this embodiment. In other embodiments, 16, 18 may be one continuous piece. FIG. 8 shows the apparatus prior to adding the cover.

Figure 2:
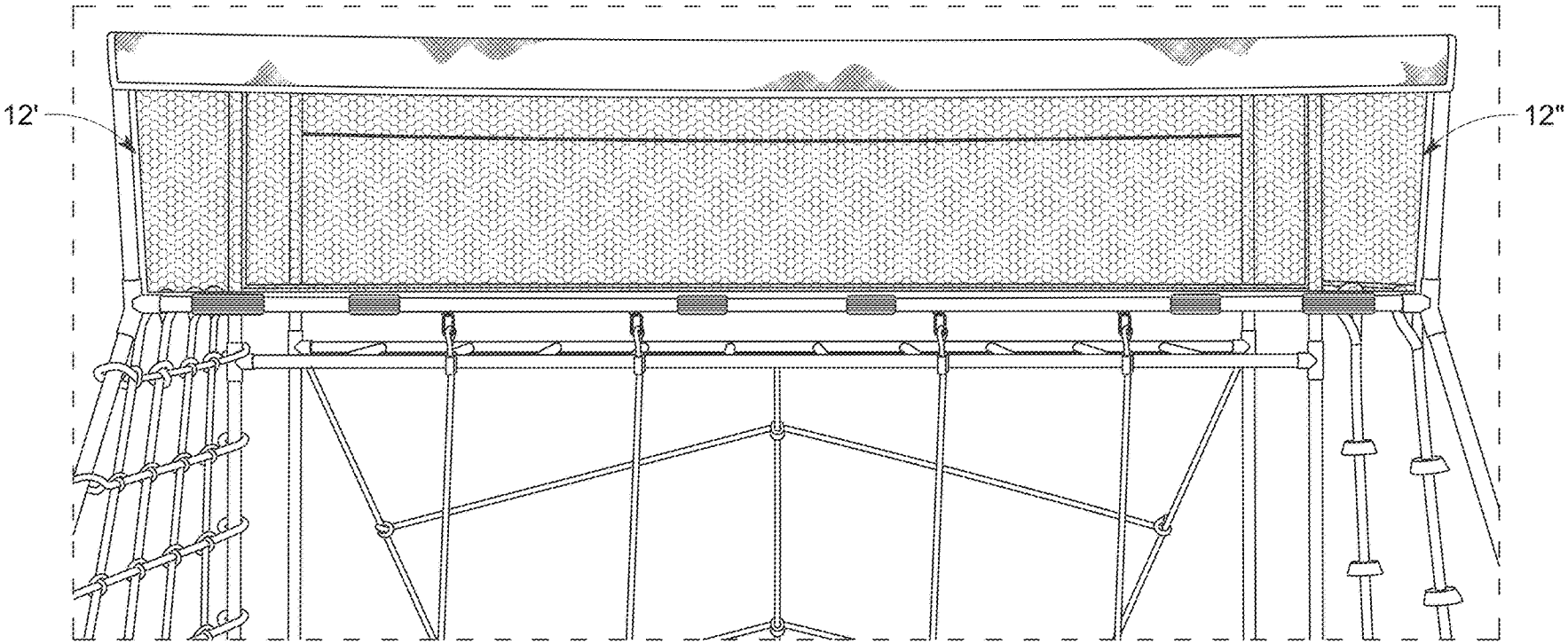
Figure 3:
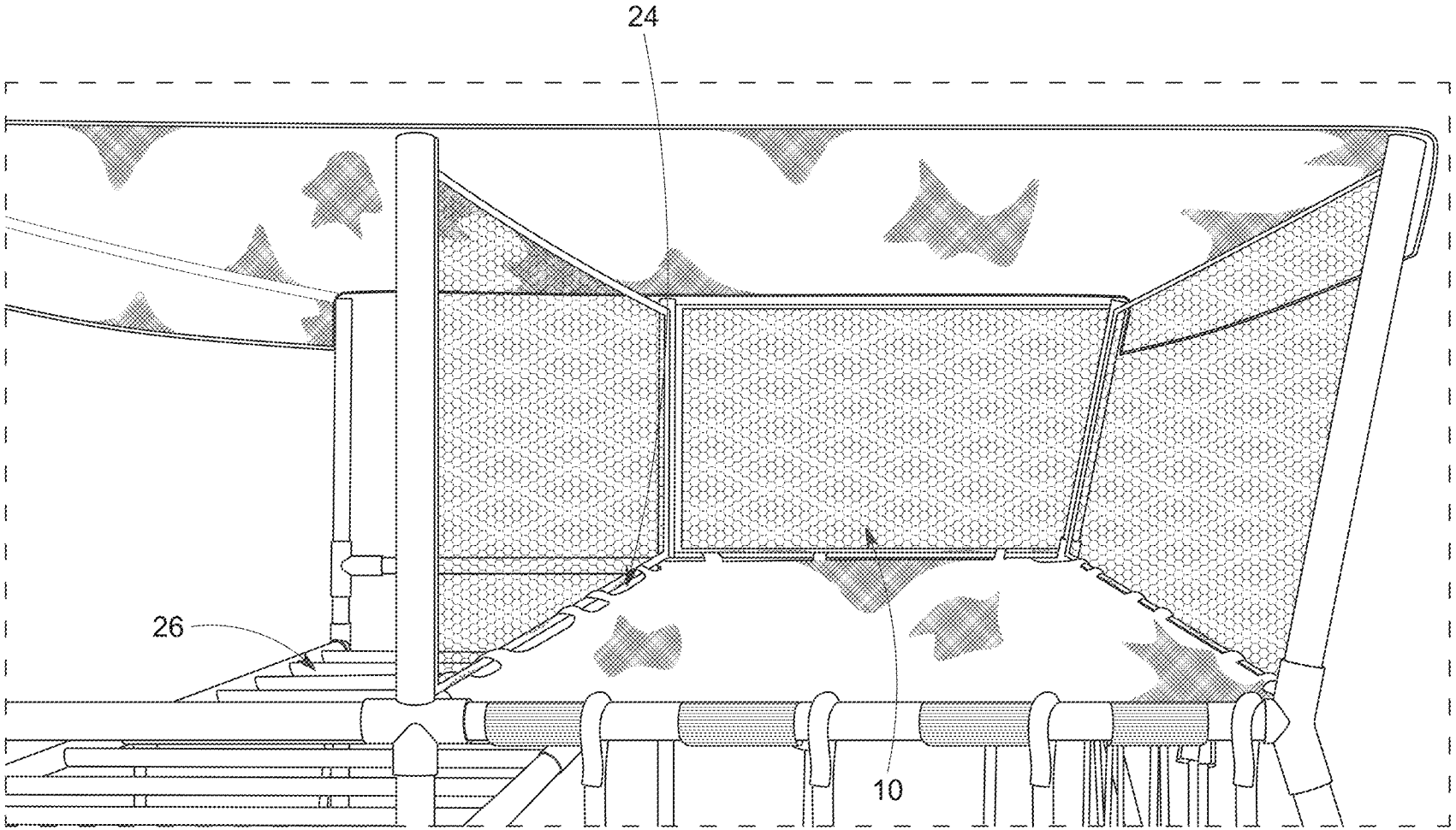
Figure 9:
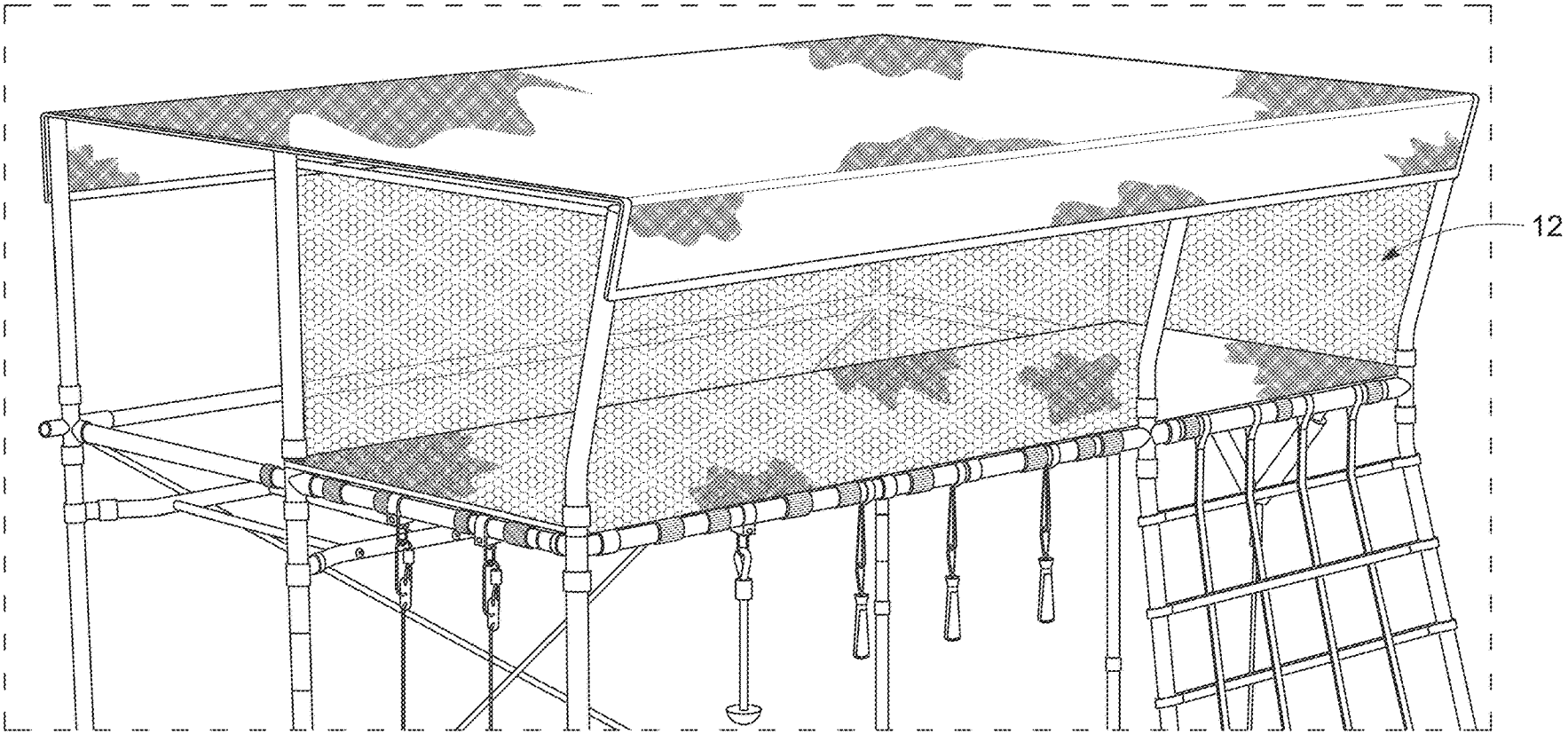
FIGS. 9 and 10 show an embodiment of a playground apparatus with a front opening.
Figure 10:
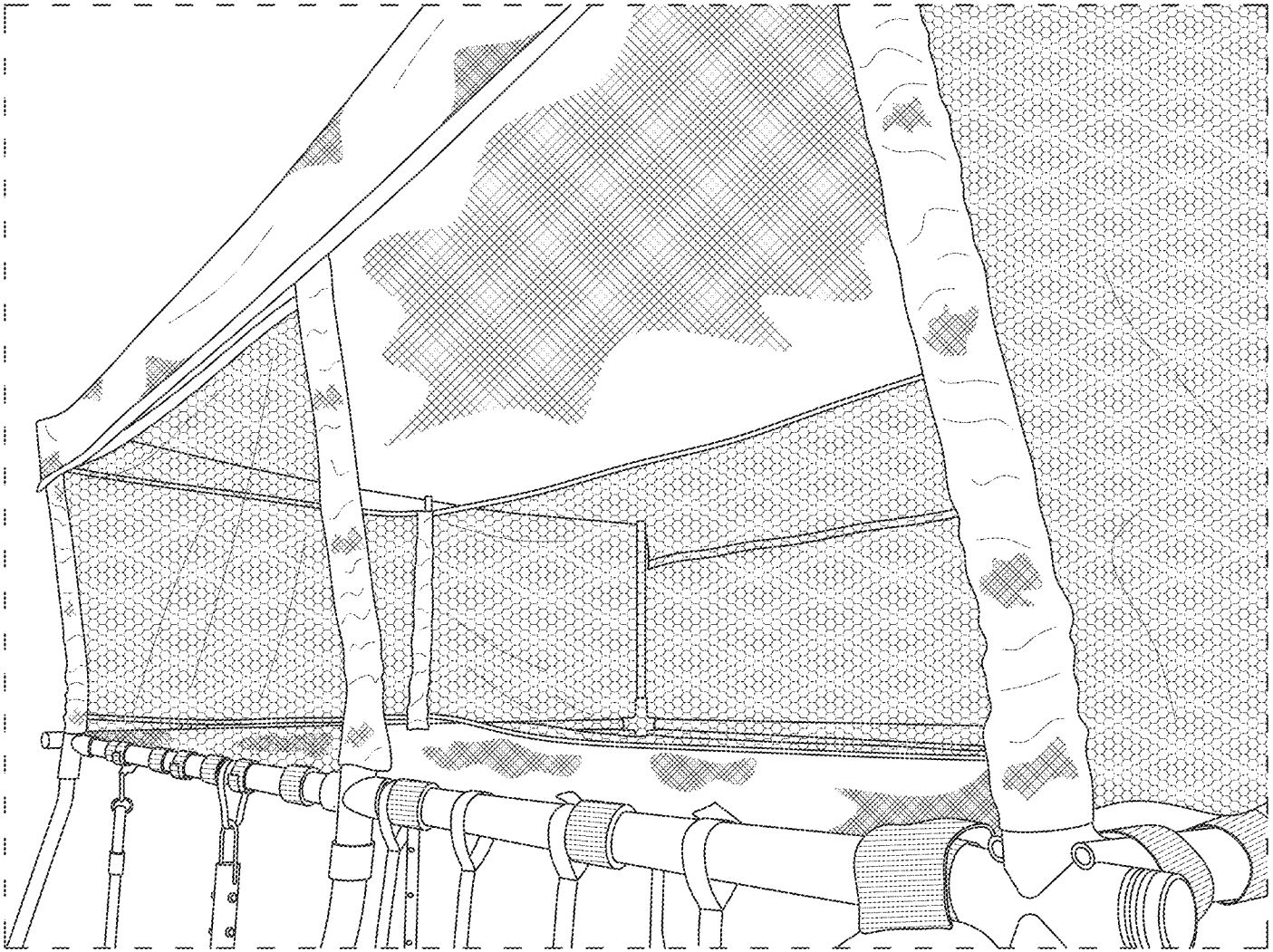

In FIG. 2, the entry 12 is provided by open end 12' or 12". The user of the apparatus can climb up the cargo net into opening 12'. The user can climb up the ropes into opening 12". In FIG. 3, the view is into an open end 12' and down the back of the enclosed mesh wall 20. In FIGS. 9 and 10, the opening is at the front face of the playground apparatus. Many variations of openings and closures can be within the spirit and scope. The enclosed space 10 in FIG. 3 is a fun place for a child to climb into and play.

Figure 4:
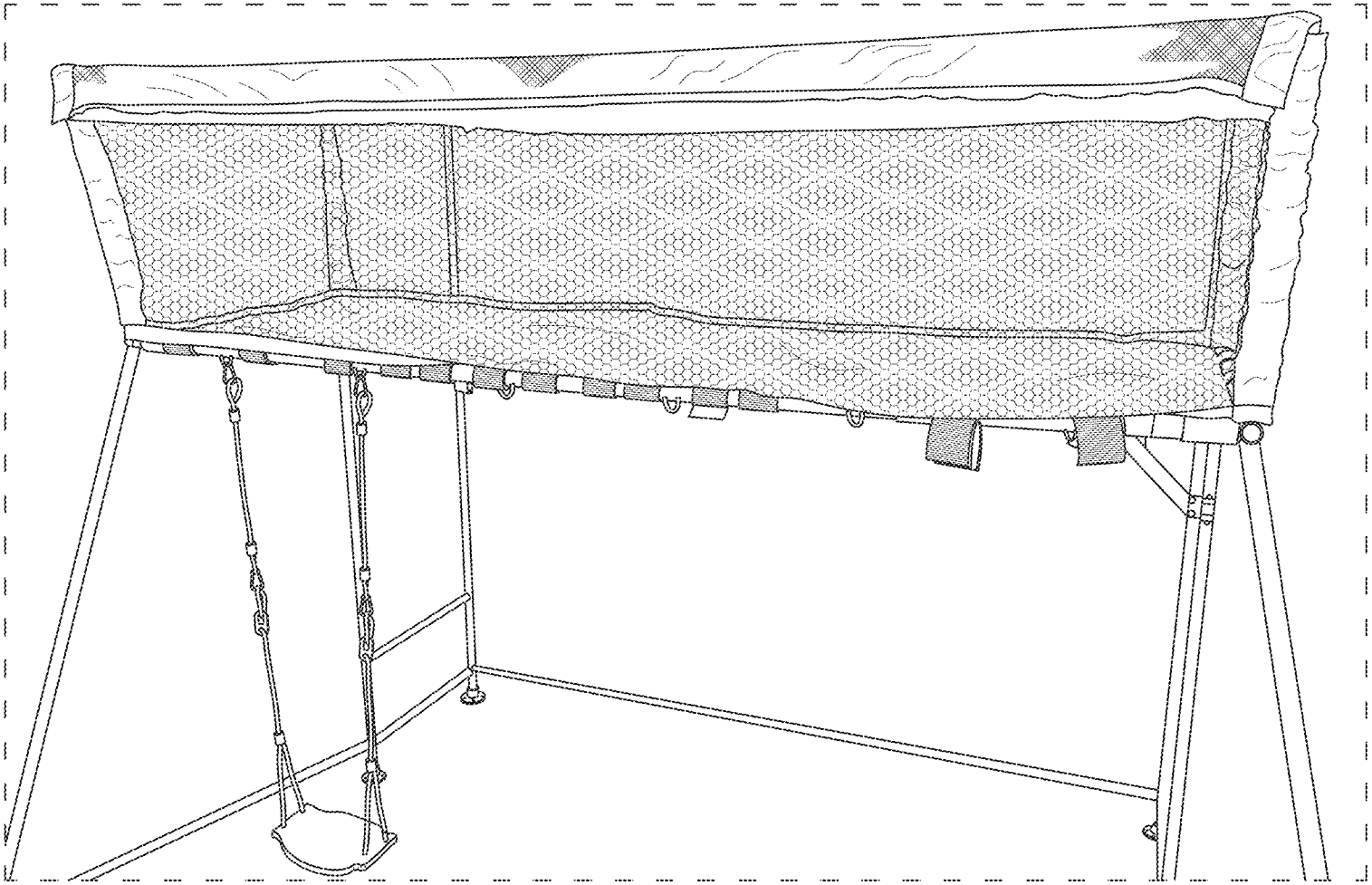
FIG. 4 is a photo of an enclosed elevated play space.
Figure 5:
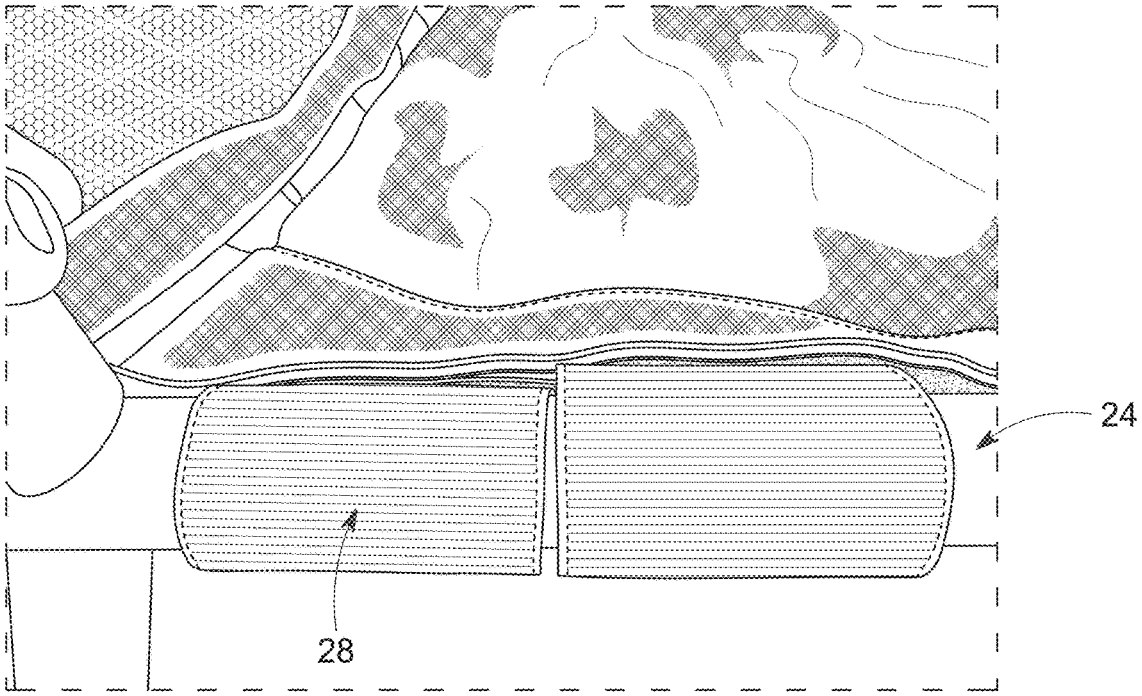
FIGS. 5, 6 and 7 are close up views of the attachment of the platform to the frame structure.

In FIG. 3, monkey bars 26 are shown disposed just lower than the frame structure 24 forming the enclosed space 10. It can be important in design that the bar 24 for the enclosed space is spaced both vertically and horizontally from the money bars 26 to reduce any likelihood that a child will get their head trapped between the two. FIGS. 4 and 5 are photos of an embodiment of the enclosed space of the elevated play area.

In FIG. 4, the hook and loop fastener can be seen some of which is connected and some of which is disconnected in this view which is during assembly. In this embodiment, the platform 22 is attached to the frame 24 along all four sides. As can be seen from the side closest in view, more of the length of an edge of the platform 22 can have fastener than does not have fastener. In an embodiment, at least about 75, 80, 85 or 90% of the length of an edge intended to be joined with the frame comprises fastener material.

Figure 6:
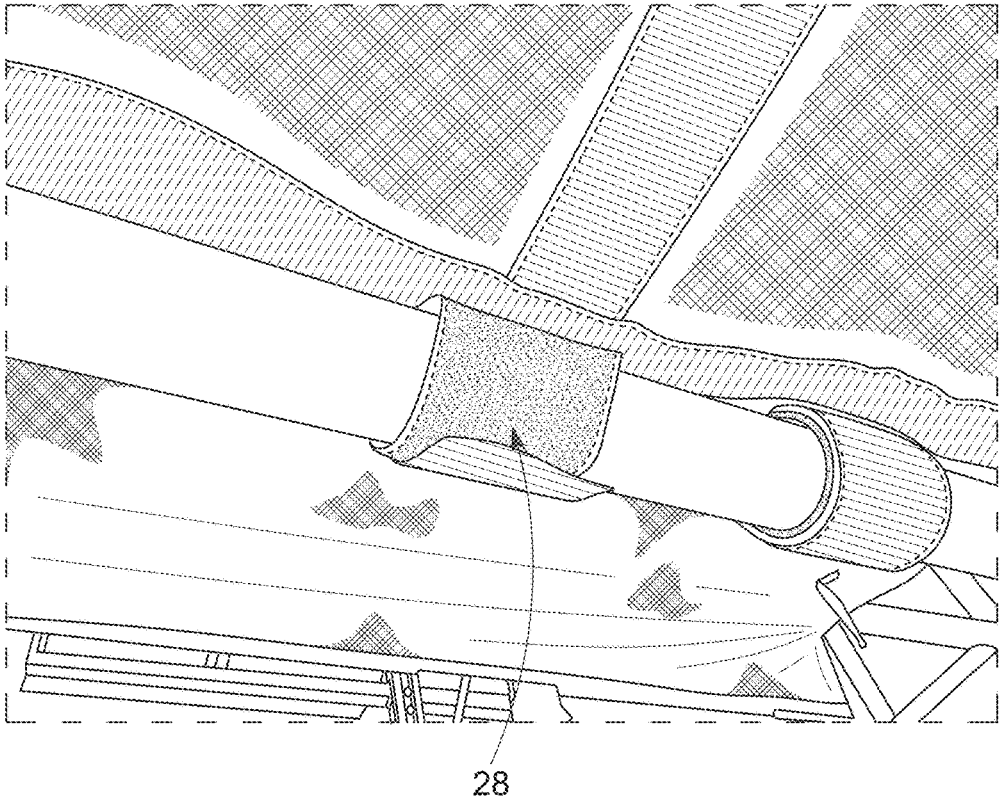
Figure 7:
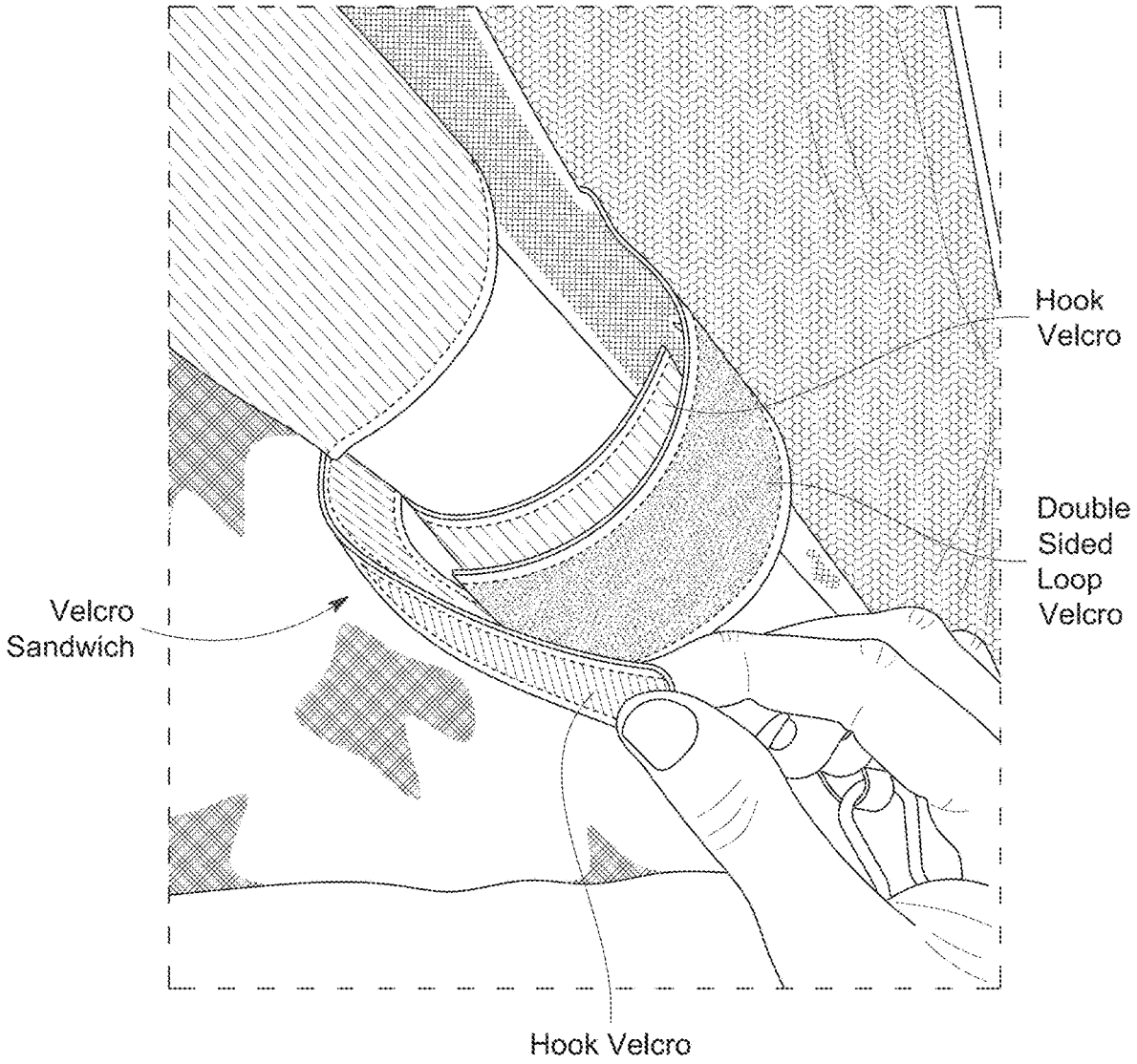

FIGS. 5 and 6 are a close ups of the Velcro hook and loop faster around In FIG. 7, the various layers of the fastener are shown.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Any promises made in the present description should be understood to relate to some embodiments of the invention, and are not intended to be promises made about the invention. Where there are promises that are deemed to apply to all embodiments of the invention, the right is reserved to later delete those promises from the description since there is no intention to rely on those promises for the acceptance or subsequent grant of a patent unless the context makes clear otherwise.

What is claimed is:

1. A playground apparatus comprising a frame structure including monkey bars for swinging from, wherein the frame structure comprises:

at least one elevated enclosure comprising a platform floor, the enclosure being supported around at least a part of its periphery by the frame structure, said elevated enclosure defining a play area beneath said platform floor, the platform floor being formed from a flexible material;

at least one monkey bars in an area not covered by the platform floor, the monkey bars formed from two longitudinal sides and a plurality of bars;

upright support poles which have one end on the ground and another end at least at the level of the platform so as to support the platform floor, wherein one of said upright support poles provides support to one of said longitudinal sides of the monkey bars;

cover support poles located near to the platform, the cover support poles support a cover that extends over at least a portion of the platform floor, the cover support poles extending either from the level of the platform floor to the cover or the cover support poles being extension of the upright support poles; and at least one side wall between the platform and the cover to provide at least a partially enclosed elevated play space in the playground apparatus.

2. The playground apparatus of claim 1, wherein the platform has four sides.

3. The playground apparatus of claim 2, wherein the platform is supported along all four sides.

4. The playground apparatus of claim 1, wherein the at least one side wall comprises mesh walls around substantially all of the enclosed elevated play space.

5. The playground apparatus of claim 1 wherein said longitudinal side of said monkey bar supported by said upright support pole extends between and is supported by two upright support posts poles that support said elevated platform.

6. A playground apparatus comprising a frame structure including monkey bars for swinging from, wherein the frame structure comprises:

at least one elevated enclosure comprising a platform floor, the enclosure being supported around at least a part of its periphery by the frame structure, said elevated enclosure defining a play area beneath said platform floor wherein the platform is attached to the frame structure by hook and loop fastener;

at least one monkey bars in an area not covered by the platform floor, the monkey bars formed from two longitudinal sides and a plurality of bars;

upright support poles which have one end on the ground and another end at least at the level of the platform so as to support the platform floor, wherein one of said upright support poles provides support to one of said longitudinal sides of the monkey bars;

cover support poles located near to the platform, the cover support poles support a cover that extends over at least a portion of the platform floor, the cover support poles extending either from the level of the platform floor to the cover or the cover support poles being extension of the upright support poles; and at least one side wall between the platform and the cover to provide at least a partially enclosed elevated play space in the playground apparatus.

7. The platform apparatus of claim 6, wherein the hook and loop faster comprises three overlapping parts.

8. The playground apparatus of claim 6, wherein more of one side of the platform comprises hook and loop fastener than being free from hook and loop fastener.

9. The playground apparatus of claim 6, wherein the hook and loop fastener comprises a series of hook and loop fasteners spaced so that a gap between successive hook and loop fasteners is not larger than about 160 mm.

10. The playground apparatus of claim 6, wherein the width of each fastener is at least about 7.5 mm.

11. A playground apparatus comprising a frame structure including monkey bars for swinging from, wherein the frame structure comprises:

at least one elevated enclosure comprising a platform floor, the enclosure being supported around at least a part of its periphery by the frame structure, said elevated enclosure defining a play area beneath said platform floor;

at least one monkey bars in an area not covered by the platform floor, the monkey bars formed from two longitudinal sides and a plurality of bars;

upright support poles which have one end on the ground and another end at least at the level of the platform so as to support the platform floor, wherein one of said upright support poles provides support to one of said longitudinal sides of the monkey bars;

cover support poles located near to the platform, the cover support poles support a cover that extends over at least a portion of the platform floor, the cover support poles extending either from the level of the platform floor to the cover or the cover support poles being extension of the upright support poles; and at least one side wall between the platform and the cover to provide at least a partially enclosed elevated play space in the playground apparatus, wherein the cover and the platform provide two substantially parallel layers of fabric in the playground apparatus with the enclosed elevated play space disposed therebetween.

12. A kit comprising components used to form a playground apparatus, the playground apparatus comprising:

(a) a frame structure formed from:

a. a plurality of horizontal bars parts;

b. a plurality of connectors for connecting horizontal bar parts to form horizontal bars;

c. a plurality of upright support pole parts;

d. a plurality of connectors for connecting upright support pole parts to form upright support poles;

wherein the frame structure once assembled includes at least one elevated enclosure and a monkey bars, said elevated enclosure having a platform floor and a cover roof and being elevated so as to provide a play area beneath said platform floor wherein said monkey bars formed from two longitudinal sides and a plurality of spaced apart bars extending between said two longitudinal sides, wherein one of the longitudinal sides being supported by one of said upright support poles also supporting said elevated enclosure;

(b) the platform floor, removably supportable in use around at least a part of its periphery by the assembled frame structure, (c) the cover roof, extendable in use over all or at least a portion of the platform floor, (d) side walls positioned in use from the platform floor to the cover roof around the periphery of the elevated enclosure other than at one or more entry/exit points for the elevated enclosure; and instructions on how to assemble the components to form the playground apparatus.

13. The kit of claim 12, wherein the platform floor is formed from a flexible material.

14. The kit of claim 13, wherein the platform floor is removably attachable to the frame structure by hook and loop fastener.

15. The kit of claim 14, wherein the hook and loop fastener comprises three overlapping parts.

16. The kit of claim 12, wherein the side walls comprise mesh walls.

17. A playground apparatus assembled from a kit, the playground apparatus comprising, (a) a frame structure formed from modular horizontal bars and modular upright support poles, and including at least one elevated enclosure having a platform floor and a cover roof, (b) the platform floor, removably supported around at least a part of its periphery by the frame structure, the platform floor being formed from a flexible material, (c) the cover roof, extending over all or at least a portion of the platform floor, (d) side walls extending from the platform floor to the cover roof around the periphery of the elevated enclosure other than at one or more entry/exit points for the elevated enclosure, (e) at least one monkey bars located in the frame structure adjacent to the elevated enclosure in an area not comprising the elevated enclosure, wherein an upright support pole that forms a part of the elevated enclosure is the same upright pole that provides support to a side of the monkey bars, wherein a longitudinal side of the monkey bars is adjacent to the elevated enclosure so a user can climb from the monkey bars to the elevated enclosure.

18. The playground apparatus of claim 17, wherein the part of the frame structure supporting the platform is formed from horizontal bars that are spaced vertically from the monkey bars.

19. The playground apparatus of claim 17, wherein the upright support poles have one end intended for placement on the ground and another end which will be in use at or towards the top of the frame, wherein the top parts of the upright support poles form cover support poles for supporting the cover roof.

20. The playground apparatus of claim 17, wherein there are two entry/exit points for the elevated enclosure.

21. The playground apparatus of claim 17, wherein the cover roof extends over all of the platform.

22. The playground apparatus of claim 17, wherein the elevated enclosure in the assembled structure is a crawlspace.

23. A playground apparatus comprising a frame structure including monkey bars, wherein the frame structure comprises:

at least one elevated enclosure comprising a platform floor and a cover roof, wherein the platform floor is of a flexible material;

side walls extending from the platform floor to the cover roof around the periphery of the elevated enclosure other than at one or more entry/exit points for the elevated enclosure;

wherein the frame structure comprises upright support poles which have one end on the ground and another end at or towards the top of the frame, and the top parts of the upright support poles form cover support poles for supporting the cover roof, wherein the cover extends over all or at least a portion of the platform and not over said monkey bars; and wherein an upright pole that forms a part of the elevated enclosure is the same upright pole that provides support to a side of the monkey bars, wherein a longitudinal side of the monkey bars is adjacent to the elevated enclosure so a user can climb from the monkey bars to the elevated enclosure.

24. The playground apparatus of claim 23 wherein said platform floor is rectangular in shape, wherein said monkey bars extend parallel to said platform floor.

* * * * *